US009945373B2

(12) United States Patent
Furuhashi et al.

(10) Patent No.: US 9,945,373 B2
(45) Date of Patent: Apr. 17, 2018

(54) DIRECT INJECTION PUMP CONTROL STRATEGY FOR NOISE REDUCTION

(71) Applicants: Denso International America, Inc., Southfield, MI (US); DENSO CORPORATION, Kariya, Aichi-pref. (JP)

(72) Inventors: Tsutomu Furuhashi, West Bloomfield, MI (US); Rebecca Spence, Novi, MI (US); Joseph Lubinski, South Lyon, MI (US); Dhyana Ramamurthy, Novi, MI (US); Kaoru Oda, Toyokawa (JP)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 4 days.

(21) Appl. No.: 15/187,821

(22) Filed: Jun. 21, 2016

(65) Prior Publication Data

US 2016/0305418 A1 Oct. 20, 2016

Related U.S. Application Data

(62) Division of application No. 14/170,768, filed on Feb. 3, 2014, now Pat. No. 9,435,335, which is a division
(Continued)

(51) Int. Cl.
*F04B 49/06* (2006.01)
*F02D 41/08* (2006.01)
(Continued)

(52) U.S. Cl.
CPC ..... *F04B 49/06* (2013.01); *F02D 41/08* (2013.01); *F02D 41/3809* (2013.01);
(Continued)

(58) Field of Classification Search
CPC ... F04B 49/06; F04B 39/0027; F02M 59/102; F02M 63/0022; F02M 59/368;
(Continued)

(56) References Cited

U.S. PATENT DOCUMENTS 4,474,309 A * 10/1984 Solomon ..... A61M 5/14224 222/1
6,135,090 A 10/2000 Kawachi et al.
(Continued)

FOREIGN PATENT DOCUMENTS

EP 1541838 A2 6/2005
JP 2008-121692 A 5/2008
(Continued)

OTHER PUBLICATIONS

Office Action from corresponding Japanese Patent Application No. 2014-161496 dated Apr. 21, 2015 with English translation.
(Continued)

*Primary Examiner* — Joseph Dallo
(74) *Attorney, Agent, or Firm* — Harness, Dickey & Pierce, P.L.C.

(57) ABSTRACT

A pump may have a first chamber and a solenoid coil to control movement of a first valve member. A second chamber may have a second valve member to control fluid moving into a third chamber. A first fluid passageway may link the first and second chambers, a second passageway may link second and third chambers and a third passageway may link third and fourth chambers. After pressurizing the third chamber causing fluid to flow into and leave a fourth chamber, the third chamber depressurizes due to downward movement of a plunger. Upon depressurization with a solenoid coil energized, second valve member floats and then moves against a valve seat. While the second valve member is moving toward the valve seat, the solenoid coil is de-
(Continued)

energized causing the first valve member to move and strike the second valve member when the second valve member is moving at maximum velocity.

15 Claims, 12 Drawing Sheets

Related U.S. Application Data of application No. 13/091,602, filed on Apr. 21, 2011, now Pat. No. 8,677,977.

(60) Provisional application No. 61/469,491, filed on Mar. 30, 2011, provisional application No. 61/329,751, filed on Apr. 30, 2010.

(51) Int. Cl.

| | |
|---|---|
| ***F02D 41/38*** | (2006.01) |
| ***F02M 59/36*** | (2006.01) |
| ***F02M 63/00*** | (2006.01) |
| ***F04B 39/00*** | (2006.01) |
| ***F02M 59/10*** | (2006.01) |

(52) U.S. Cl.

CPC ..... *F02M 59/102* (2013.01); *F02M 59/368* (2013.01); *F02M 63/0022* (2013.01); *F04B 39/0027* (2013.01); *F02D 2200/101* (2013.01); *F02D 2200/602* (2013.01); *F02M 2200/09* (2013.01); *F02M 2200/302* (2013.01)

(58) Field of Classification Search

CPC ..... F02M 2200/09; F02M 2200/302; F02D 41/3809; F02D 41/08; F02D 2200/602; F02D 2200/101

See application file for complete search history.

(56) References Cited

U.S. PATENT DOCUMENTS

| | | | | |
|---|---|---|---|---|
| 6,345,608 | B1 | 2/2002 | Rembold et al. | |
| 6,526,947 | B2 | 3/2003 | Shimada et al. | |
| 7,293,548 | B2 | 11/2007 | Oono | |
| 7,299,790 | B2 | 11/2007 | Okamoto et al. | |
| 7,517,200 | B2 | 4/2009 | Ferleyko et al. | |
| 7,540,274 | B2 | 6/2009 | Yamada et al. | |
| 7,546,832 | B2 | 6/2009 | Okamoto et al. | |
| 7,552,720 | B2 | 6/2009 | Borg et al. | |
| 7,757,667 | B2 | 7/2010 | Okamoto et al. | |
| 8,011,350 | B2 | 9/2011 | Oono | |
| 2005/0126539 | A1 | 6/2005 | Okamoto | |
| 2006/0118089 | A1 | 6/2006 | Tokuo et al. | |
| 2006/0147317 | A1 | 7/2006 | Okamoto et al. | |
| 2007/0034191 | A1 | 2/2007 | Oono | |
| 2007/0236089 | A1 | 10/2007 | Okubo | |
| 2008/0216797 | A1 | 9/2008 | Oono | |
| 2009/0114292 | A1 | 5/2009 | Shafer et al. | |
| 2009/0120412 | A1 | 5/2009 | Tokuo et al. | |
| 2011/0295493 | A1 | 12/2011 | Wilms et al. | |
| 2012/0090708 | A1* | 4/2012 | Usui | F02M 63/0017 137/565.16 |
| 2012/0093670 | A1* | 4/2012 | Usui | F02M 63/0017 417/505 |

FOREIGN PATENT DOCUMENTS

| | | | |
|---|---|---|---|
| JP | 2009-074504 | A | 4/2009 |
| JP | 2009-293459 | A | 12/2009 |
| JP | 2010-533820 | A | 10/2010 |
| JP | 2012-511659 | A | 5/2012 |
| WO | WO-2010/066675 | A1 | 6/2010 |

OTHER PUBLICATIONS

Decision of Final Rejection dated Nov. 11, 2014 in corresponding Japanese Application No. 2011-097116 with English translation.

Office Action from corresponding Chinese Application No. 201110113575.0 dated Aug. 2, 2013 with English translation.

* cited by examiner

TDC
BDC
110
112
114
116
118
On Beyond cam TDC
On pulse to slow needle down before impact
On decayed
On stepped decay
ON
OFF
Cam Lift Profile
Typical Signal
Option 1 Signal
Option 2 Signal
Option 3 Signal
Option 4 Signal

DIRECT INJECTION PUMP CONTROL STRATEGY FOR NOISE REDUCTION

CROSS-REFERENCE TO RELATED APPLICATIONS

This application is a divisional of U.S. patent application Ser. No. 14/170,768 filed on Feb. 3, 2014 which is a divisional of U.S. patent application Ser. No. 13/091,602 filed on Apr. 21, 2011. This application claims the benefit of U.S. Provisional Application No. 61/329,751, filed on Apr. 30, 2010 and the benefit of U.S. Provisional Application No. 61/469,491, filed on Mar. 30, 2011. The entire disclosures of the above applications are incorporated herein by reference.

FIELD

The present disclosure relates to a method of controlling a direct injection pump, such as may be used for supplying pressurized fuel to a direct injection internal combustion engine.

BACKGROUND

This section provides background information related to the present disclosure which is not necessarily prior art. Some modern internal combustion engines, such as engines fuel with gasoline, may employ direct fuel injection, which is controlled, in part, by a gasoline direct injection pump. While such gasoline direct injection pumps have been satisfactory for their intended purposes, a need for improvement exists. One such need for improvement may exist in the control of a pressure control valve. In operation, internal parts of a pressure control valve may come into contact with adjacent parts, which may cause noise that is audible to a human being standing a few feet (e.g. 3 feet or about 1 meter) away from an operating direct injection pump. Thus, improvements in methods of control to reduce audible noise of a direct injection pump are desirable.

SUMMARY

This section provides a general summary of the disclosure, and is not a comprehensive disclosure of its full scope or all of its features. A method of controlling a pump may involve providing four chambers within a chamber casing that defines an inlet into the first chamber. Adjacent to a first chamber, a solenoid coil may reside. Energizing and de-energizing the solenoid coil may control movement of a first movable valve member (e.g. a needle). The method may also involve providing a second chamber within the chamber casing with a second movable valve member. The second chamber may be located next to the first chamber and a first aperture may define a fluid passageway between first chamber and second chamber. The method may further involve providing a third chamber within the chamber casing that is open to a sleeve, which may be cylindrical, and contain a plunger. The method may also involve providing a second wall that defines a second aperture as a fluid passageway between the second chamber and the third chamber. The method may also involve providing a fourth chamber with a third movable valve member and a third wall that defines a third aperture between the third chamber and the fourth chamber. The third aperture may define a fluid passageway between the third chamber and the fourth chamber.

The method may involve drawing fluid into the third chamber through the inlet, first chamber and second chamber. Then, energizing the solenoid coil may cause movement of the first movable valve member. The second movable valve member may move. Next, moving the plunger to a top-dead-center ("TDC") position of plunger in the third chamber may permit pressurization of fluid in the third chamber. Then, maintaining energization of the solenoid coil as the plunger moves past the TDC position of the plunger will permit the first movable valve member to remain adjacent the solenoid coil. Next, energization of the solenoid coil may stop thereby causing the first movable valve member to move and strike the second movable valve member. An end of the first movable valve member that is adjacent to the solenoid coil is opposite from an end of the first movable valve member that strikes the second moveable valve member, and an end of the second moveable valve member that strikes a wall or seat, is opposite from an end of the second movable valve member that strikes an end of the first movable valve member. The method may also involve attaching a spring (e.g. needle spring) to an end of the first movable valve member (e.g. needle) such that the needle spring is proximate a center of the solenoid coil and the needle spring is at least partially surrounded by the solenoid coil. The method may also involve providing the first movable valve member partially within the first chamber and the second chamber, attaching a suction valve spring to a suction valve (e.g. the second movable valve member) such that suction valve spring may bias the suction valve against a seat. The needle spring force is greater than the suction valve spring force such that when the solenoid coil is not energized, the needle and suction valve are in contact, and the suction valve is open (not in contact with the seat/wall and away from (not drawn to) the solenoid coil. De-energizing the solenoid coil may occur at a maximum velocity of the suction valve or at a maximum velocity of the plunger during the suction stroke (downward movement away from the third chamber).

The method may also involve providing a cam with a plurality of cam lobes, rotating the cam and contacting an end of the plunger via a follower (there is no direct contact between the plunger and the cam lobe) with the plurality of cam lobes to move the plunger into and away from the third chamber. The method may also involve providing a third movable valve member and a spring attached to third movable valve member, and biasing the third movable valve member with the third movable valve member spring against third wall to seal the fourth chamber from the third chamber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

With reference to FIGS. 1-15, a method of controlling a direct injection fuel pump and in conjunction with surrounding vehicle fuel system components will be described.

Figure 1:
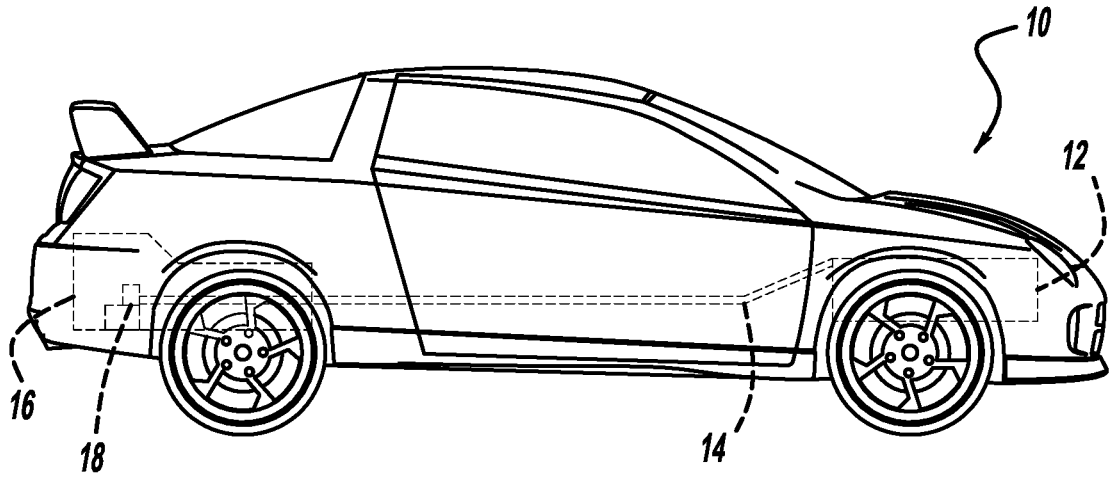
FIG. 1 is a side view of a vehicle depicting a fuel system controlled by a method of operation in accordance with the present disclosure.
Figure 2:
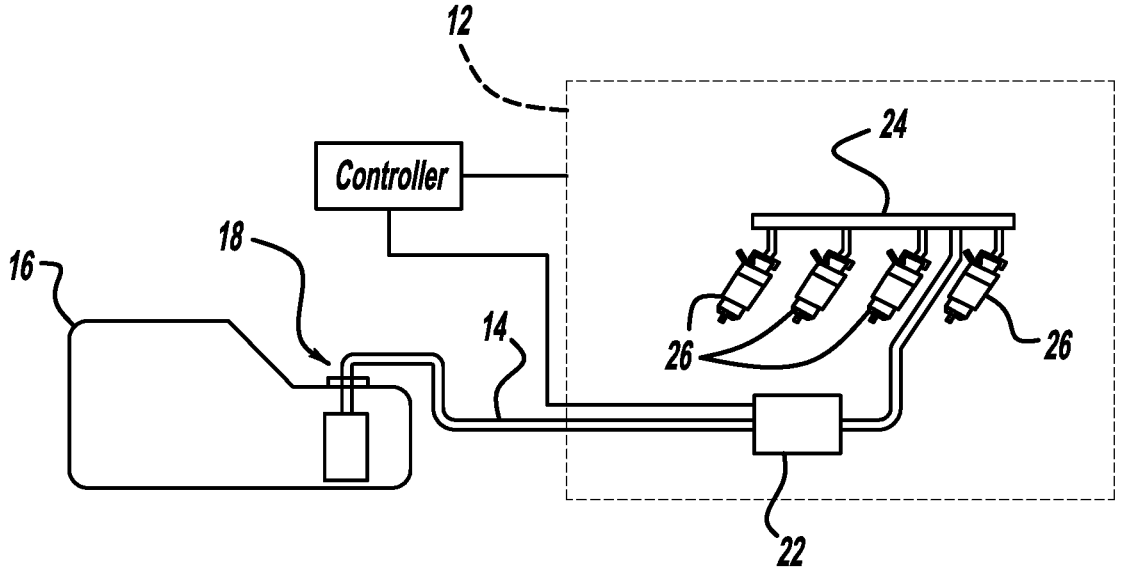
FIG. 2 is a side view of the vehicle fuel system of FIG. 1, depicting fuel injectors, a common rail, and a direct injection fuel pump controlled by a method of operation in accordance with the present disclosure.

With reference first to FIGS. 1-2, a vehicle 10, such as an automobile, is depicted having an engine 12, a fuel supply line 14, a fuel tank 16, and a fuel pump module 18. Fuel pump module 18 may mount within fuel tank 16 using a flange and may be submerged in or surrounded by varying amounts of liquid fuel within fuel tank 16 when fuel tank 16 possesses liquid fuel. An electric fuel pump within fuel pump module 18 may pump fuel from fuel tank 16 to a direct injection fuel pump 22, which is a high-pressure pump, through fuel supply line 14. Upon reaching direct injection fuel pump 22, liquid fuel may then be further pressurized before being directed into common rail 24 from which fuel injectors 26 receive fuel for ultimate combustion within combustion cylinders of engine 12.

Figure 3A:
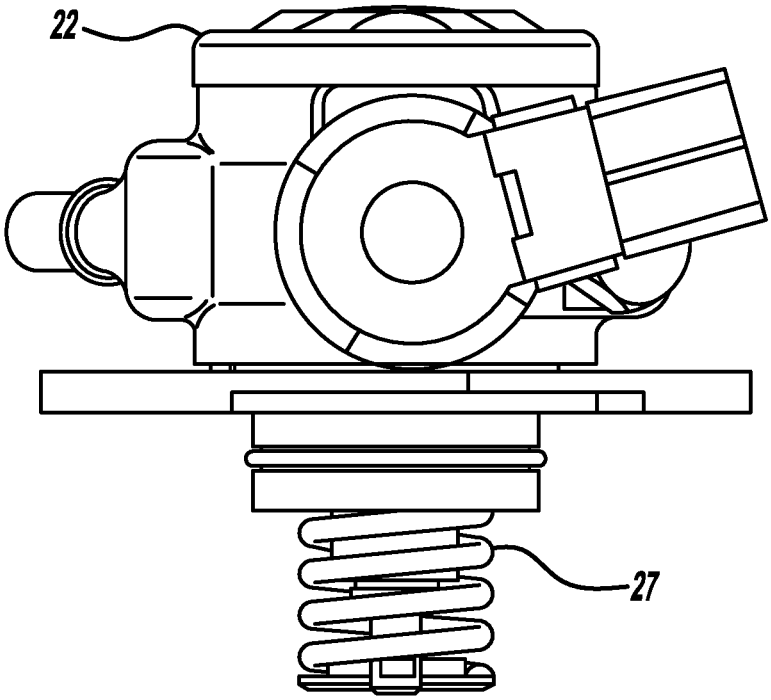
FIG. 3A is a side view of the fuel system fuel pump of FIG. 2 in accordance with the present disclosure.
Figure 3B:
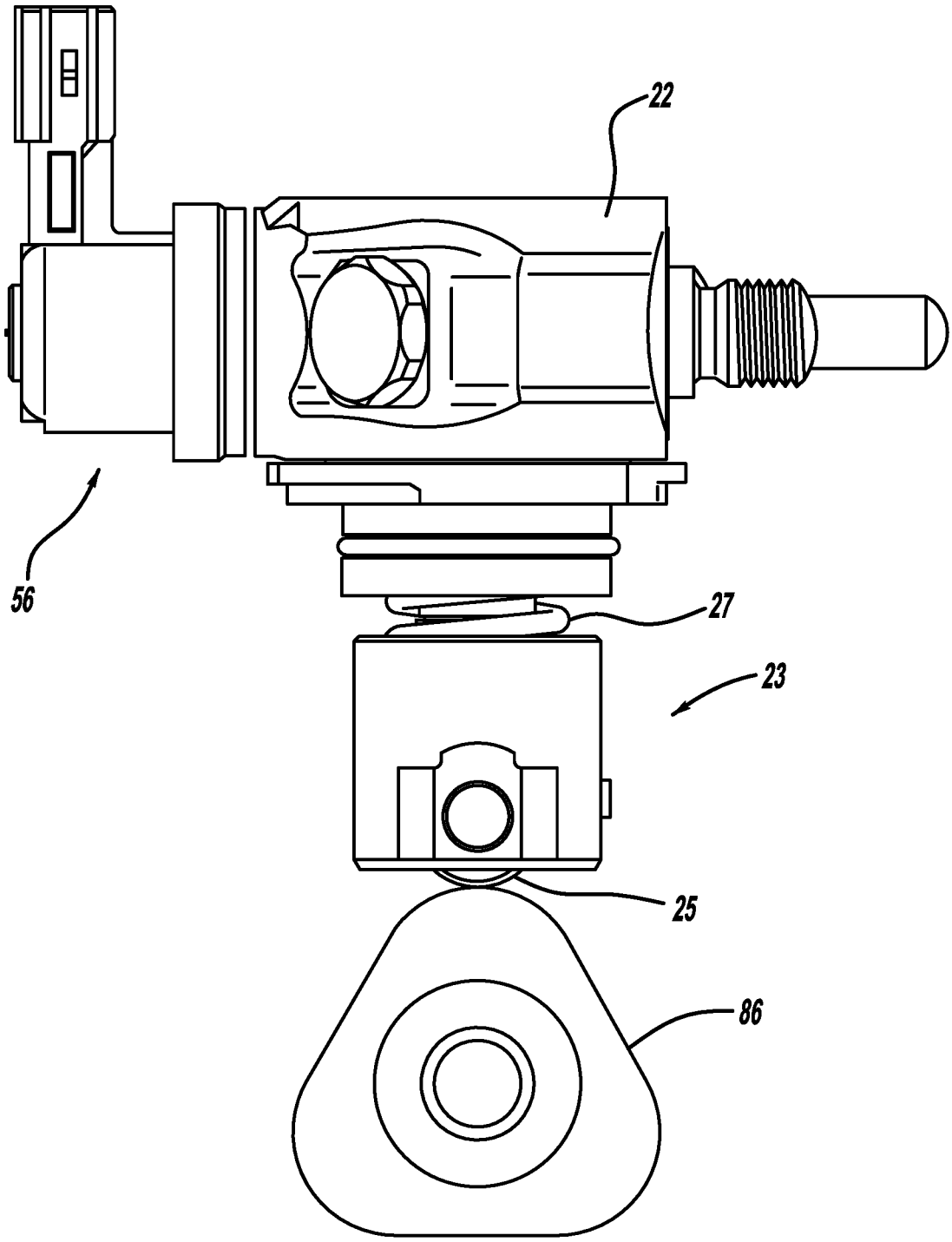
FIG. 3B is a perspective view of a high pressure fuel pump in accordance with the present disclosure.

FIG. 3A is a side view of direct injection fuel pump 22 of FIG. 2 in accordance with the present disclosure. Direct injection fuel pump 22 may employ a follower spring 27 to maintain force against a follower 23 (e.g. a cam follower), which is depicted in FIG. 3B. A roller 25 may be part of follower 23, and it is roller 25 that makes contact with cam 86, and more specifically, contact with lobes of cam 86. Because follower spring 27 maintains constant force against follower 23, roller 25 may maintain continuous contact with an outside surface of cam 86.

Figure 4:
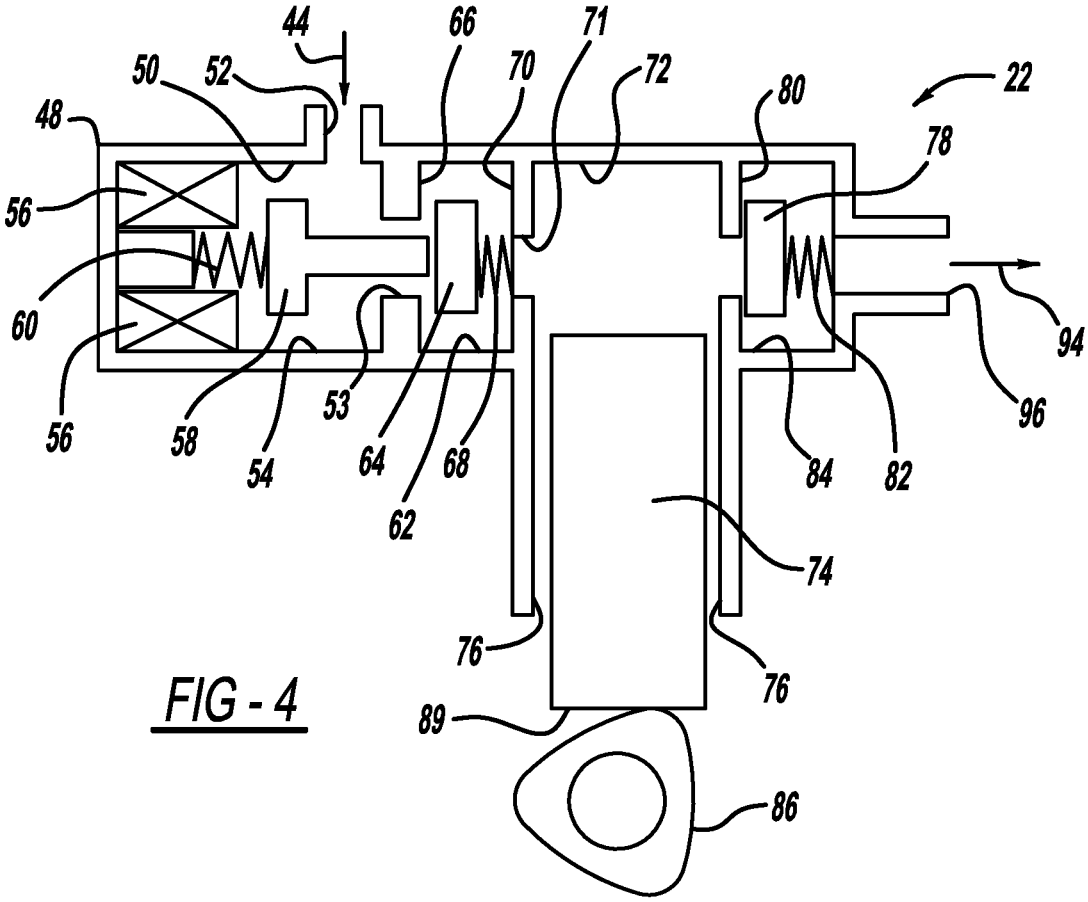
FIG. 4 is a cross-sectional schematic view of a direct injection fuel pump controlled by a method of operation in accordance with the present disclosure.

With reference now including FIG. 4, a structure and an associated method of controlling direct injection fuel pump 22, by an engine controller or pump controller for example, will be presented. Direct injection fuel pump 22 may include an overall casing or outer casing 48 that generally defines an internal cavity 50 that defines other, smaller cavities and houses a variety of structures and parts that operate to pressurize and control fuel passing through direct injection fuel pump 22. Liquid fuel, such as gasoline, may flow through fuel supply line 14, which may be connected to or ultimately lead to an inlet 52 of pressure control valve ("PCV") portion of direct injection fuel pump 22. Fuel flowing in accordance with arrow 44 may pass through inlet 52 and enter a first chamber 54 housing a needle 58 and a needle spring 60 which biases against an end of needle 58. Needle 58 may also be known as a first movable valve member 58 and needle spring 60 may be known as a first movable valve member spring 60. A solenoid coil 56 is located outside of chamber 54. A second chamber 62 may house a suction valve 64 which may cooperate or work in conjunction with needle 58 and engage and disengage with valve seat 66 to govern the flow of fuel through direct injection fuel pump 22. Suction valve 64 may also be known as a second movable valve member 64. Suction valve 64 may be biased with a spring 68 which may bias against wall 70, for example. Upon suction valve 64 becoming unseated from valve seat 66, fuel passes into a third chamber 72, which may be a pressurization chamber 72, where plunger 74, whose outside diameter creates a seal yet permits sliding with internal diameter or surface 76, pressurizes fuel to a desired pressure. Output pressure from pressurization chamber 72 is dependent upon the required output pressure of an internal combustion engine application. Outlet check valve 78 may seat and unseat from valve seat 80 in a fourth chamber 84 in accordance with a spring constant of spring 82. Check valve 78 may help maintain high pressure in the fuel rail when pump 22 is in a suction stroke. To further facilitate pressurization of fuel in pressurization chamber 72, an end 89 of plunger 74 rides upon or contacts lobe(s) of cam 86, via a follower 23 which may be directly or indirectly driven by rotation of engine 12. Therefore, different plunger lengths and cam lobes may affect pressurization of fuel within chamber 72.

Figure 5A:
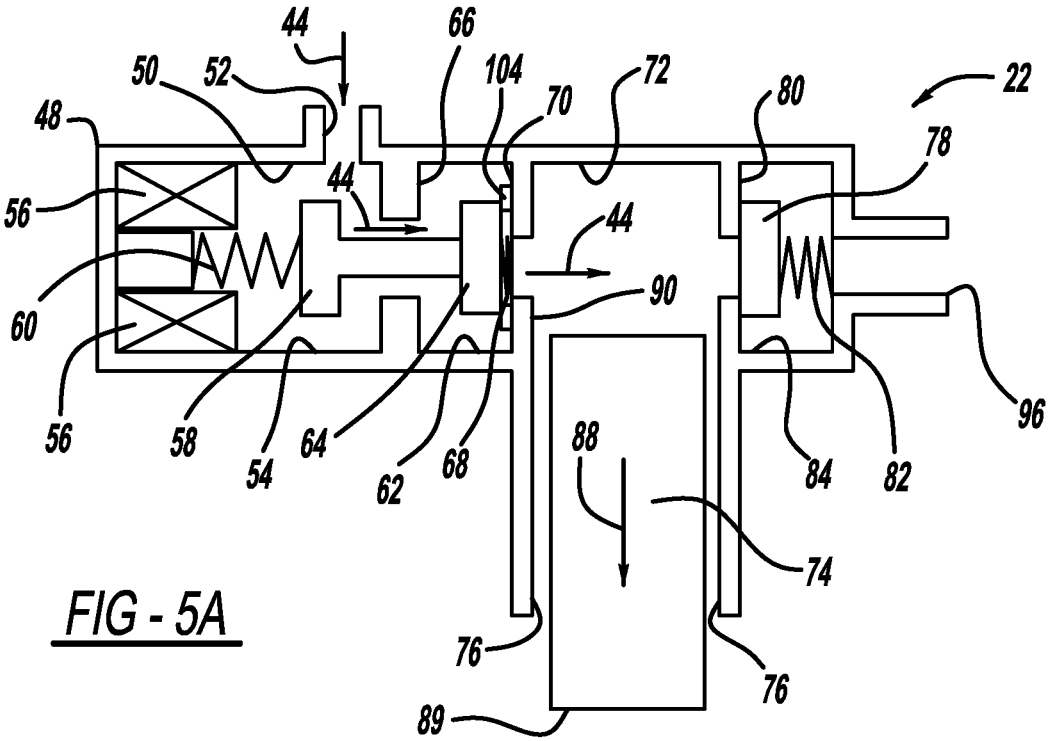
FIG. 5A-5E are cross-sectional schematic views of a direct injection fuel pump depicting plunger, needle valve and suction valve locations in accordance with a method of operation of the present disclosure.

Turning now to FIGS. 5A-5E, and with reference to FIG. 6, more specific control of direct injection fuel pump 22 will be described in accordance with the present disclosure. FIG. 5A depicts a suction stroke with fuel entering first chamber 54 in accordance with arrow 44, which is made possible when solenoid coil 56 is de-energized, or turned off. When solenoid coil 56 is de-energized, needle spring 60 is able to force needle 58 away from solenoid coil 56 such that needle 58 contacts suction valve 64 (such as when suction valve 64 is moving between seat 66 and toward stop 104) and forces it against spring 68 such that spring 68 compresses. As spring 68 compresses, suction valve 64 moves from valve seat 66 to permit fuel to flow past suction valve 64 and into pressurization chamber 72. Flow of fuel in accordance with arrow 44 is facilitated or hastened by plunger 74 moving downward in accordance with arrow 88 as end 89 of plunger 74 rides along a surface of cam 86 via a follower 23, as mentioned in conjunction with FIG. 4. Downward movement of plunger 74 creates a suction force due to a vacuum that forms within pressurization chamber 72. Check valve 78 may be seated against and form a seal with valve seat 80 as plunger 74 moves in accordance with arrow 88, away from pressurization chamber 72. Force of spring 82 also facilitates seating of check valve 78 against seat 80 during a suction stroke of plunger 74; moreover, vacuum created within pressurization chamber 72 also draws check valve toward seat 80. Thus, FIG. 5A depicts a scenario in which solenoid coil 56 is electrically de-energized so that fuel may be drawn into pressurization chamber 72 by plunger 74. As depicted in FIG. 6, the position of plunger 74 of suction stroke of FIG. 5A may coincide with decreasing or lessening cam lift, such as at position 75 of curve 73.

Figure 5B:
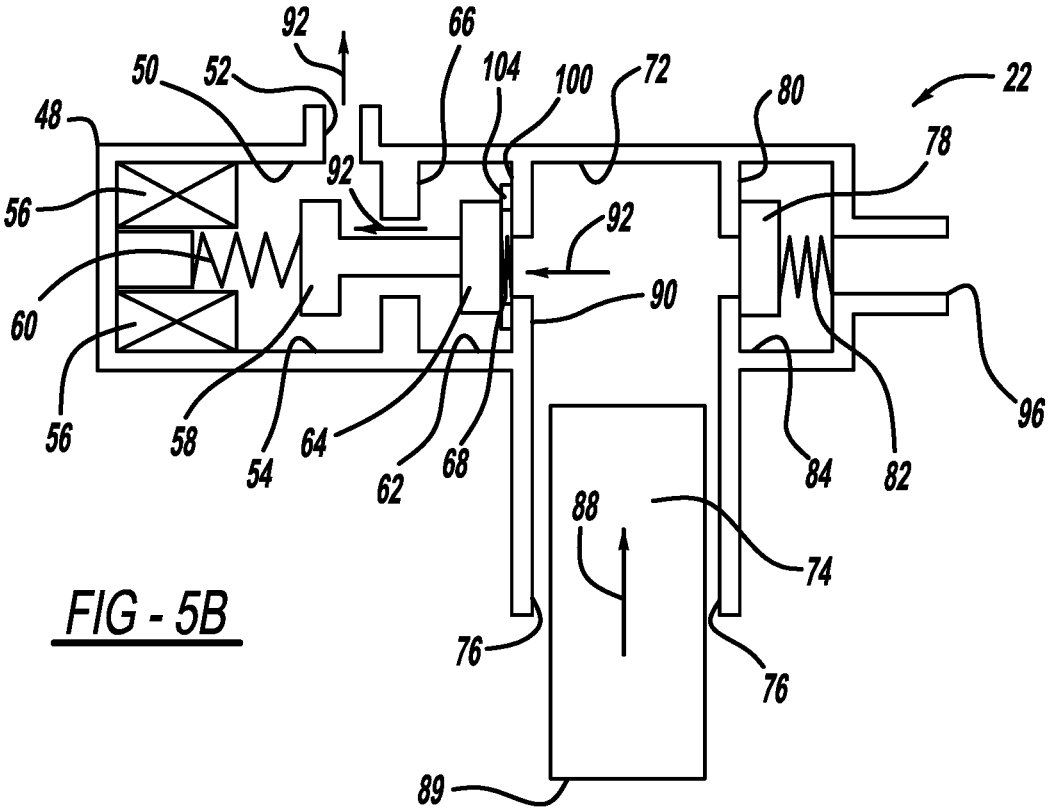
Figure 6:
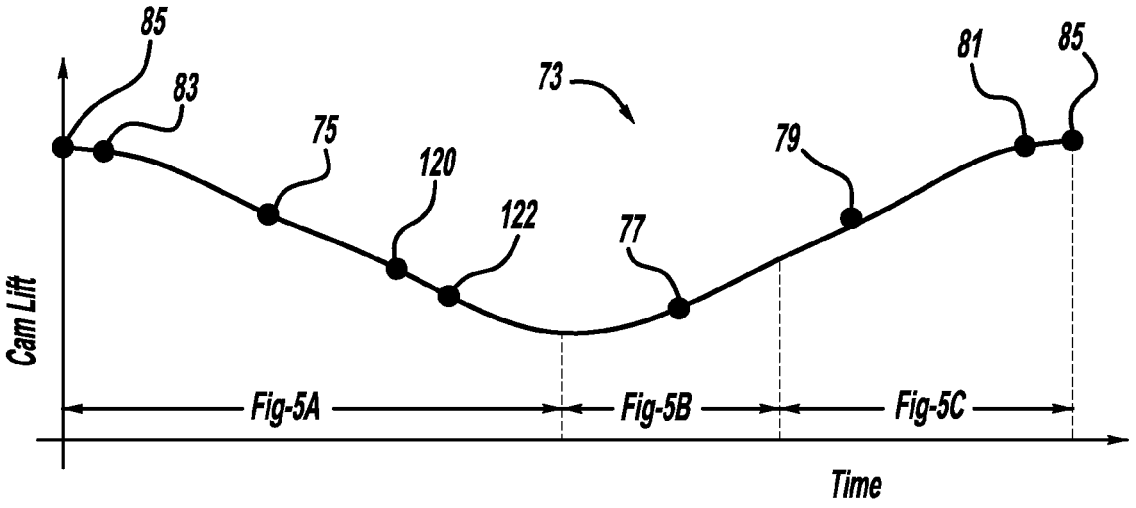
FIG. 6 is a graph depicting relative cam positions with respect to locations of a needle and suction valve of a direct injection fuel pump in accordance with a method of operation of the present disclosure.

With reference to FIGS. 5B and 6, a pre-stroke or pre-pressurization stroke is depicted when plunger 74 moves upward in accordance with arrow 88 within a cylinder or sleeve 90. As depicted in FIG. 6, a pre-stroke phase constitutes a movement in which cam 86 (FIG. 4) is in the process of lifting plunger 74; however, fuel is able to flow out of direct injection fuel pump 22 in accordance with arrows 92 (before suction valve 64 is seated), and thus, fuel is not yet pressurized in pressurization chamber 72. Thus, FIG. 5B represents a scenario such that when solenoid coil 56 is off or de-energized, even though force of needle spring 60 is greater than a force of flowing fuel 92 caused by plunger 74, fuel may flow from pressurization chamber 72 through direct injection fuel pump 22 and out of casing inlet or pump inlet 52 while suction valves moves toward (floats) towards stop 104. Check valve 78 may be seated against valve seat 80 during pre-stroke of FIG. 5B and suction valve 64 may be seated against stop 104, in which plunger 74 begins moving upwards. As depicted in FIG. 6, the position of plunger 74 of pre-stroke stroke of FIG. 5B may coincide with increasing cam lift, such as at position 77 of curve 73.

Figure 5C:
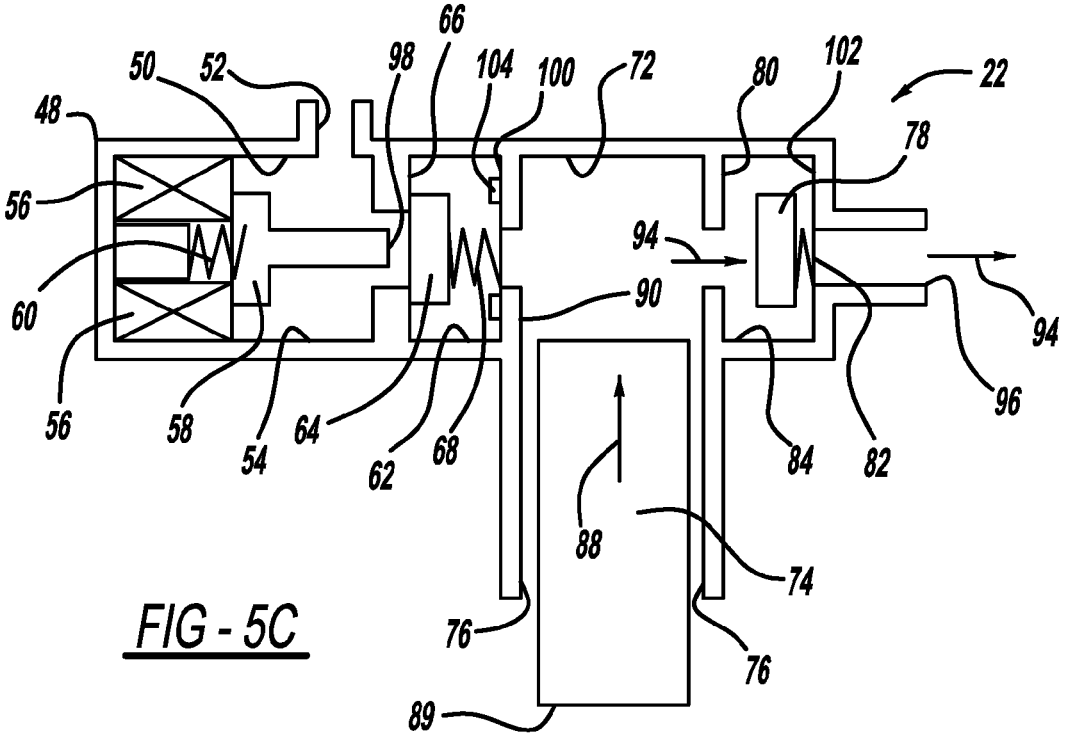

FIG. 5C depicts a pumping stroke in which solenoid coil 56 is energized and in which plunger 74 moves further upward or toward pressurization chamber 72 in accordance with arrow 88 as a continuation of the pre-pressurization stroke of FIG. 5B. As plunger 74 moves within sleeve 90, fuel is pressurized within pressurization chamber 72. As depicted in FIG. 6, a pumping stroke phase constitutes a movement in which cam 86 (FIGS. 3B and 4) is in the process of lifting or moving plunger 74 toward and to a position of top dead center ("TDC") relative to lifting or movement capabilities of cam 86. However, fuel is able to flow through direct injection fuel pump 22 and exit pump 22 at outlet 96 in accordance with arrows 94, and thus, fuel is pressurized in pressurization chamber 72. Thus, FIG. 5C represents a scenario such that when solenoid coil 56 is on or energized, force of energized solenoid coil 56 attracts needle 58, thereby compressing needle spring 60 and removing needle end 98 from contact with suction valve 64. Thus, spring 68 then biases suction valve 64 against valve seat 66 to prevent fuel from flowing into first chamber or inlet chamber 54 and instead fuel is forced to flow into fourth chamber or exit chamber 84 and from outlet 96 when check valve spring 82 compresses.

Continuing with FIG. 5C, when fuel is exiting from outlet 96, the force of flowing fuel and/or associated pressure in chamber 72 may be greater than the resistant or compressive force of spring 82 against check valve 78 to permit compression of spring 82 and movement of check valve 78 such that fuel 94 is able to exit from outlet 96. Spring 68 may bias against wall 100 when suction valve 64 is closing and subsequently closed. Similarly, spring 82 may bias against wall 102 when check valve 78 is opening or closing. Thus, FIGS. 5A through 5C each represent a position of plunger 74, a corresponding status (e.g. on or off) of solenoid coil 56 and an effect of plunger 74 position and solenoid coil 56 status on fuel flow through direct injection fuel pump 22. As depicted in FIG. 6, the position of plunger 74 of pumping stroke of FIG. 5C may coincide with increasing cam lift, such as at position 79 of curve 73.

Figure 5D:
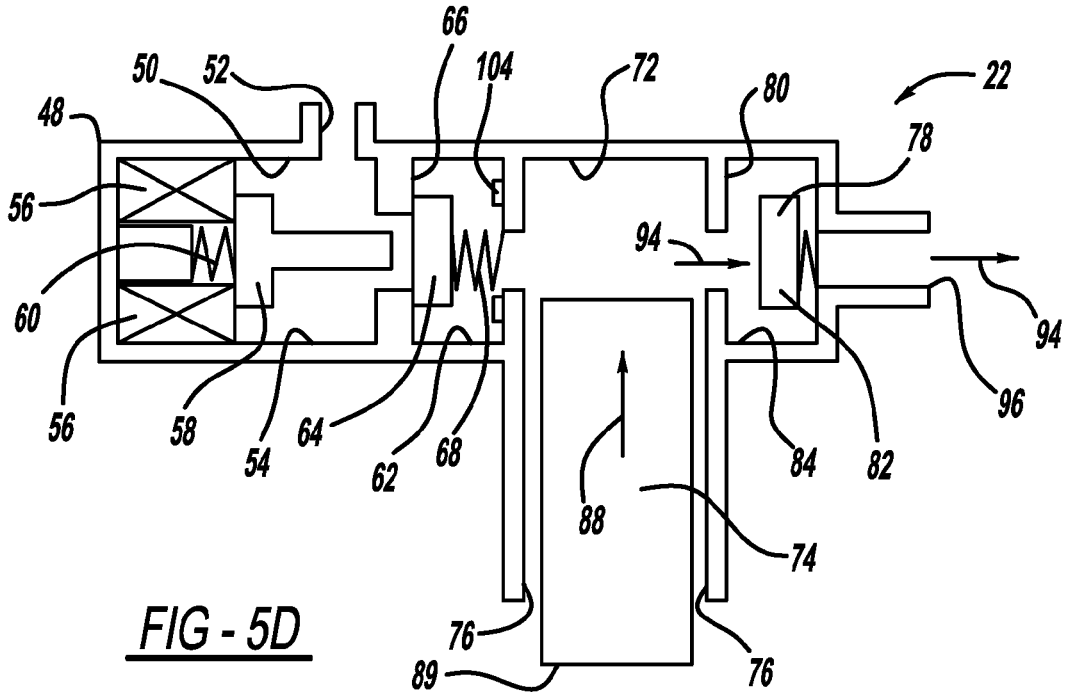

FIG. 5D depicts positions of internal parts such as needle 58 and suction valve 64. More specifically, a position of needle 58 is immediately prior to TDC as plunger 74 is approaching TDC, which occurs when an end of plunger 74 contacts a portion of cam via follower 23 that places an opposite end of plunger 74 closest to pressurizing chamber 72. Because solenoid coil 56 is turned on or energized, needle 58 is drawn away from suction valve 64 so that needle 58 is not touching suction valve 64 as plunger 74 approaches TDC. Also, FIG. 5D depicts suction valve 64 not in contact with stop 104. As depicted in FIG. 6, the position of plunger 74 of pumping stroke of FIG. 5D may coincide with increasing cam lift, such as at position 81 of curve 73, which is just prior to TDC position 85 of plunger 74.

Figure 5E:
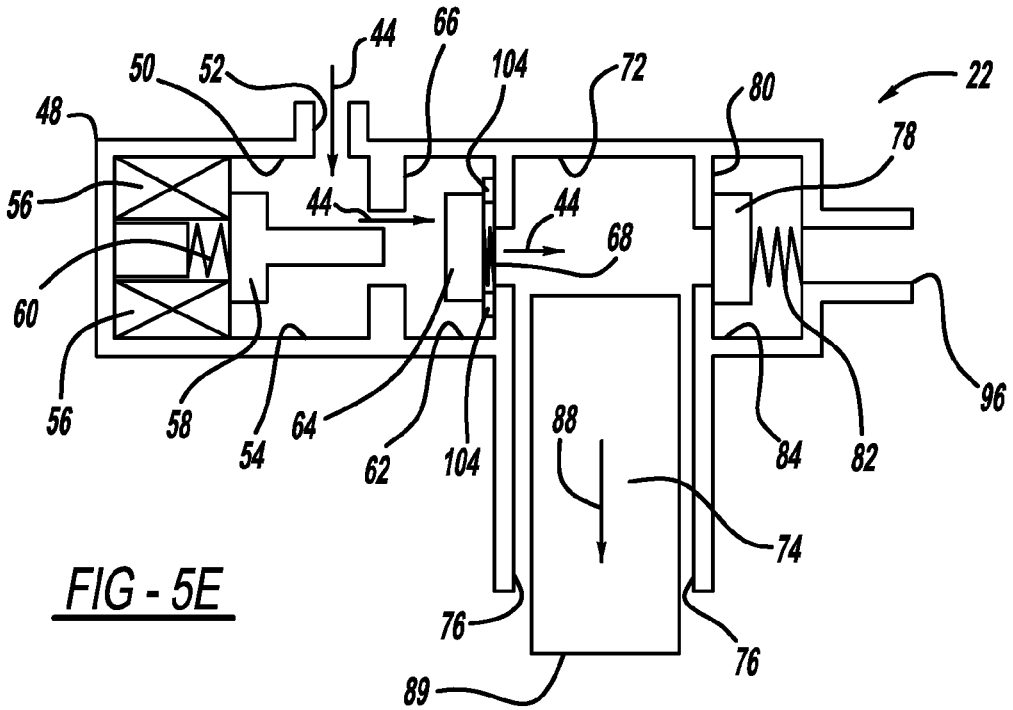

FIG. 5E depicts internal parts such as needle 58 and suction valve 64 when needle 58 is immediately after TDC of cam 86. That is plunger 74 is beginning to move away from TDC and may be in an initial position of a suction stroke. In FIG. 5E, only suction valve 64 makes contact with stop 104, as opposed to a combination of needle 58 and suction valve 64 as a single mass in contact with each other, because solenoid coil 56 remains energized and thus needle 58 remains drawn to solenoid coil 56 and secured away from suction valve 64. A stop may be provided for needle, since needle does not actually contact solenoid coil 56. Suction valve will be floating at most engine speed values (at most rpm) due to plunger vacuum. Floating means that suction valve 64 resides between seat 66 and stop 104, without contacting either. For suction valve 64 to contact stop 104, solenoid coil 56 must be de-energized and needle 58 must push suction valve 64 against stop 104. Vacuum of plunger 74 by itself does not create enough force to cause suction valve to contact stop 104.

Suction valve 64 may approach stop 104, but not contact stop 104, just after plunger 74 begins to move away from TDC because pressure within pressurization chamber 72 decreases to a pressure that permits compression of spring 68 to permit fuel to again to be drawn into inlet 52 and past valve 64 and into pressurization chamber 72 due to a decrease of pressure within pressurization chamber 72. Thus, because needle 58 is secured away from suction valve 64 by an energized solenoid coil 56, suction valve 64 moves toward stop 104 (i.e. the suction valve 64 is floating). Next, solenoid coil 56 is de-energized, needle 58 moves away from solenoid coil 56 and toward suction valve 64 and strikes suction valve 64 (at a maximum velocity of suction valve 64) while suction valve 64 is floating. Thus, needle 58 and suction valve 64, as a combined mass, contact stop 104 and generate noise. The distance travelled by the combined mass is reduced by de-energizing the coil after TDC. This reduces momentum, and hence reduces impact energy and corresponding noise from such impact. Subsequent to some point just after TDC, such as when the pressure within pressurization chamber 72 becomes low enough to permit spring 82 to permit outlet check valve 78 to close, plunger 74 begins a suction stroke again. To begin drawing fuel into pressurization chamber 72, needle 58 is released from solenoid coil 56 by de-energizing solenoid coil 56 and permitting needle 58 to strike suction valve 64. When needle 58 strikes suction valve 64, audible noise may occur. Thus, in accordance with the motion explained above, and in conjunction with FIG. 5D, a first noise that is generated, which may be heard outside of vehicle 10, is when needle 58 strikes suction valve 64 when suction valve 64 is floating or moving towards stop 104 but has not yet reached stop 104. Such a noise generating scenario creates less noise as compared to a scenario in which needle 58 and suction valve 64 are permitted to travel a larger distance together as a single mass in contact with each other and then strike stop 104. As depicted in FIG. 6, the position of plunger 74 of pumping stroke of FIG. 5E may coincide with initial stages of decreasing cam lift, such as at position 83 of curve 73, which is just after TDC position 85 of plunger 74. When valve 64 moves towards stop 104, fluid may still pass around valve 64 and into third chamber 72.

Figure 7A:
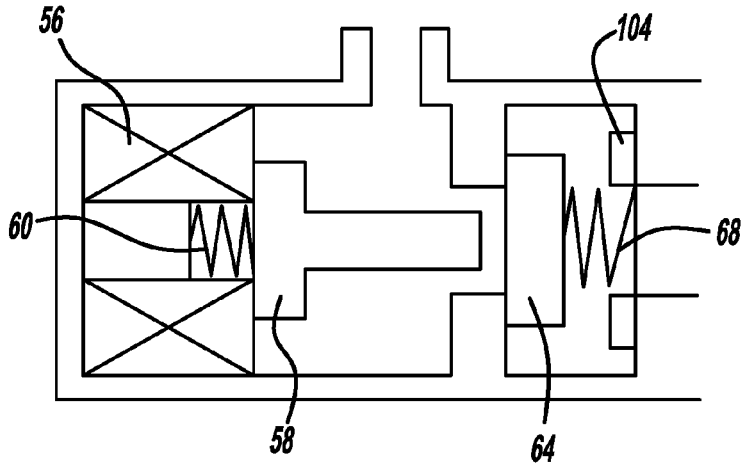
FIGS. 7A-7C depict various positions of a needle and suction valve of a direct injection fuel pump in accordance with a method of operation of the present disclosure.
Figure 7B:
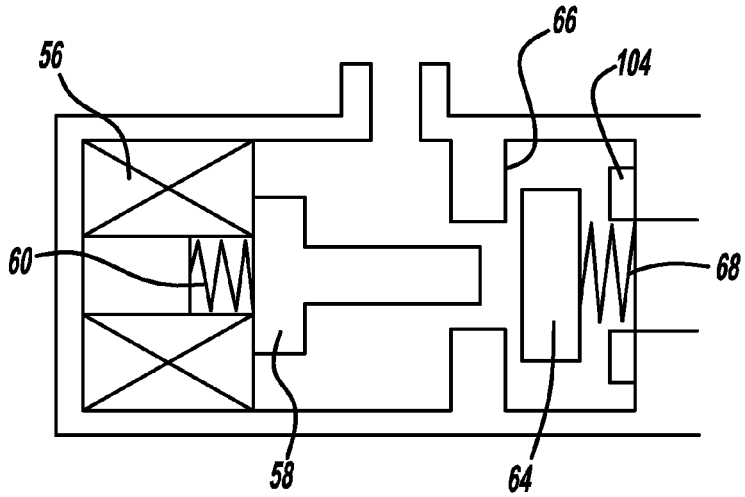
Figure 7C:
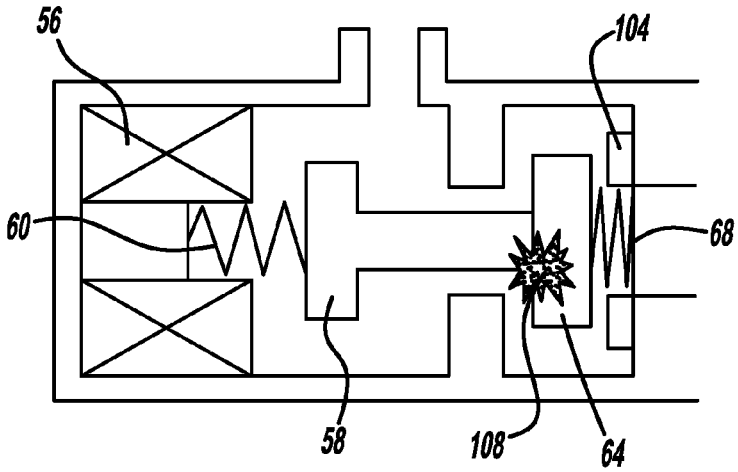

FIGS. 7A-7C highlight positions of internal components of direct injection fuel pump 22. For example, FIGS. 7B and 7C highlight noise generating positions of components of direct injection fuel pump 22. However, because FIG. 7A depicts positions of needle 58 and suction valve 64 just before plunger 74 reaches TDC, position of suction valve 64 as depicted does not generate or cause any noise because suction valve 64 has not yet contacted stop 104 or suction valve 64, as explained above. With reference to FIG. 7B, pressure in pressurization chamber 72 changes and becomes lower as plunger 74 travels downward (FIG. 5E). This lowering of pressure assists in causing suction valve 64 to be drawn towards stop 104. However, solenoid coil is turned on or energized, thus drawing needle 58 adjacent solenoid coil 56 and away from suction valve 64, so that needle 58 is drawn away from suction valve 64 and may not touch suction valve 64. Upon suction valve alone moving toward stop 104 as depicted in FIG. 7B, plunger 74 is approaching TDC and subsequently reaches TDC and then begins its descent from TDC, as depicted in FIG. 7C. Moreover, FIG. 7C depicts needle 58 striking suction valve 64 after solenoid coil 56 de-energizes and releases needle 58. Needle 58 moves due to the force of needle spring 60 biasing against needle 58. At the same time, the pressure within pressurization chamber 72 may decrease to hasten movement of needle 58 into suction valve 64 while suction valve 64 is floating. As depicted in FIG. 7C, upon needle 58 striking suction valve 64, an audible noise may occur, as indicated by alert 108. Next, needle 59 and suction valve 64 travel together and strike stop 104, causing a second audible noise (see FIG. 5A for audible contact of combined mass of needle 58 and suction valve 64 with stop 104). Each audible impact is lower than a single mass of valve 58 and suction valve 64 travelling together from seat 66 and impacting together as a single, large mass, which would create a single louder impact.

In short, in operation, after plunger 74 passes TDC, plunger 74 begins moving downward or away from third chamber 72, which causes a suction force or vacuum within third chamber 72 and a suction force against suction valve 64. The suction force causes suction valve 64 to begin moving from seat 66 and toward stop 104, but not all the way to stop 104. Solenoid 56 is de-energized after plunger 74 passes TDC and so, as suction valve 64 is 'floating/moving', which means suction valve is between seat 66 and stop 104, and needle 58 strikes suction valve 64 during this floating, which causes an audible noise. Needle 58 and suction valve 64 are then in contact with each other and together travel as one mass until suction valve 64 strikes stop 104. However, the distance traveled by needle 58 and suction valve 64 together is reduced since suction valve 64 is already moving towards stop 104. Thus, the impact of needle 58 and suction valve 64 together striking stop 104 is lessened and thus, any audible noise is reduced. Additionally, needle 58 impacting suction valve 64 is timed so that it occurs when suction valve 64 is at its maximum velocity to reduce the audible noise of needle 58 striking suction valve 64, before needle 58 and suction valve 64 together, as a single or combined mass, strike stop 104.

Figure 8:
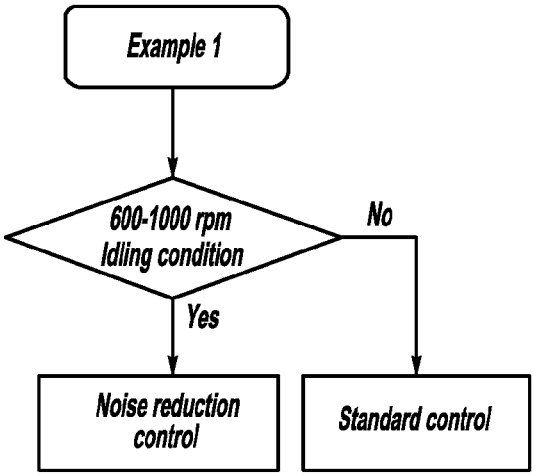
FIG. 8 is a flowchart depicting a method of controlling a direct injection fuel pump in accordance with the present disclosure.
Figure 9:
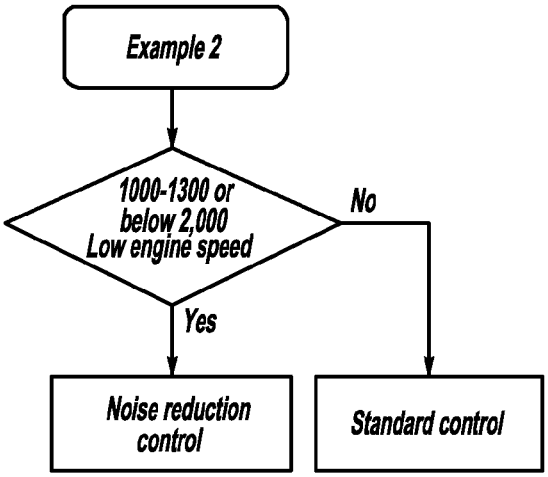
FIG. 9 is a flowchart depicting a method of controlling a direct injection fuel pump in accordance with the present disclosure.
Figure 10:
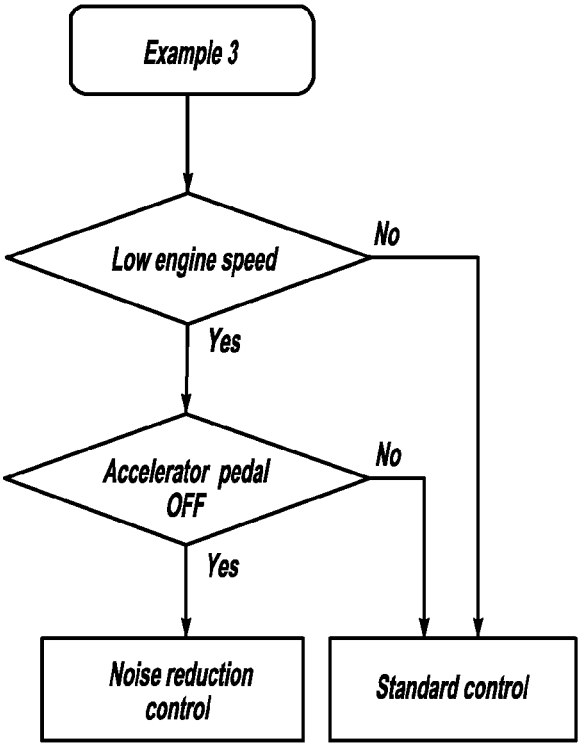
FIG. 10 is a flowchart depicting a method of controlling a direct injection fuel pump in accordance with the present disclosure.

FIGS. 8 and 9 depict flowcharts in which a decision to invoke noise reduction control or operation of a direct injection fuel pump in accordance with the present disclosure is decided based upon the speed (e.g. rotations per minute or RPMs) at which an engine of a vehicle, such as vehicle 10, is operating. More specifically, in FIG. 8, if an engine of a vehicle is experiencing an idling condition, such as rotating from 600 to 1000 rpm, then noise reduction control strategy may be invoked. As another example in FIG. 9, noise reduction control of direct injection fuel pump may be invoked only if engine 12 is operating at 1,000-1,300 RPM, or as yet another example, below 2,000 RPMs. Still yet, FIG. 10 depicts a flowchart in which determining whether or not to invoke noise reduction control of direct injection fuel pump 22 depends upon multiple determinations. For instance, noise reduction control may only be invoked if an engine speed threshold (e.g. engine RPMs between 1,000-1,300) is met and an accelerator pedal is not depressed (i.e. not being used). If noise reduction strategy of direct injection fuel pump 22 is not invoked, then standard control of direct injection fuel pump 22 is utilized. Noise reduction control may include the scenario explained in conjunction with FIGS. 5A-5E and FIGS. 7A-7C. A non-noise reduction control strategy or standard control (FIGS. 8-10) may include de-energizing solenoid prior to TDC.

Figures 11A, 11B, 11C, 11D, 11E, 11F:
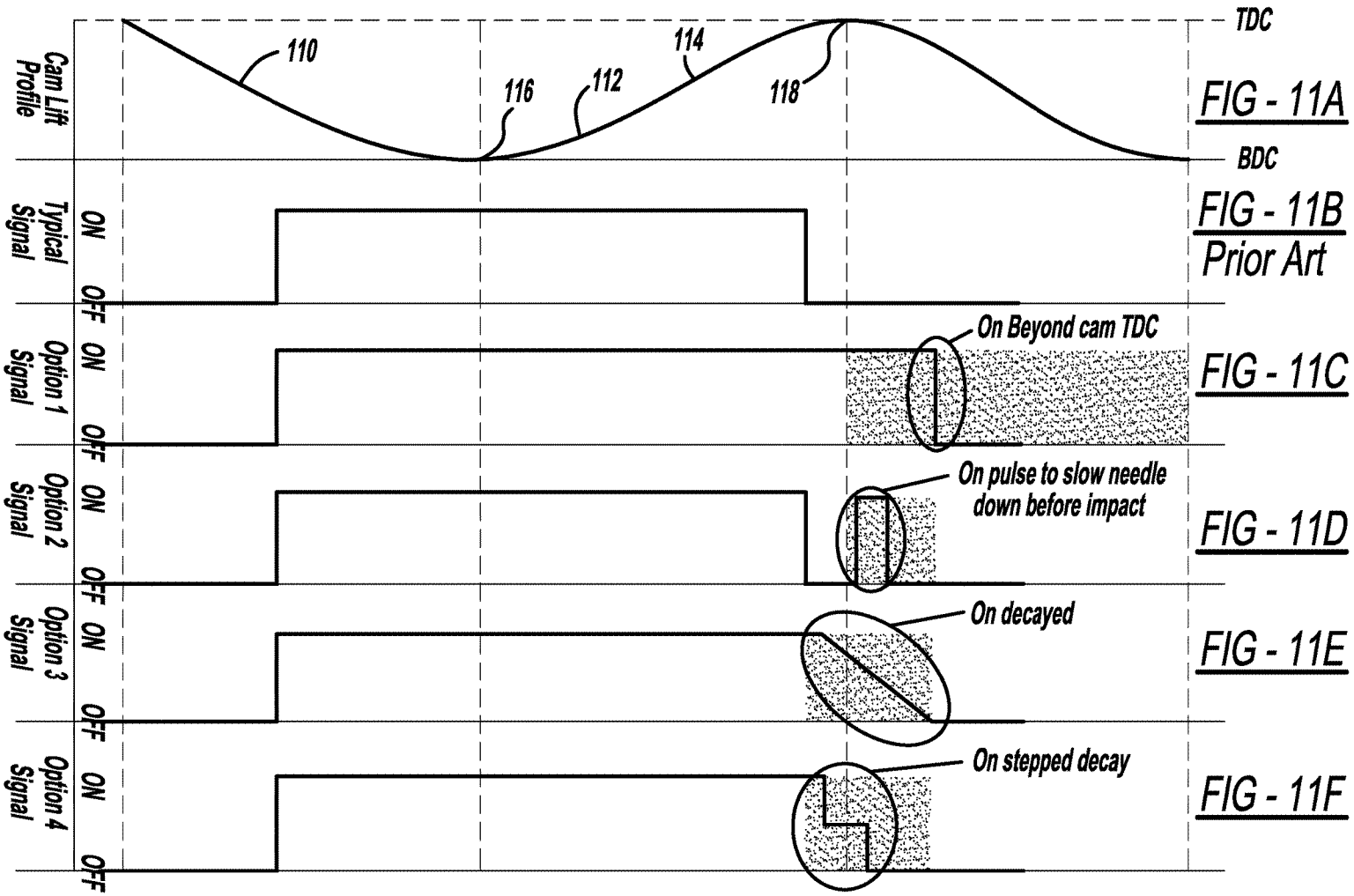
FIG - 11B Prior Art
FIGS. 11A-11F depict a series of direct injection pump control strategies in accordance with the present disclosure.

FIGS. 11A-11F depicts a series of control strategies for controlling direct injection fuel pump 22. FIG. 11A depicts cam lift profile vs. time. Cam lift increases along the y or vertical axis and time increases along the x or horizontal axis, from a meeting or intersection of the x and y axis. FIG. 11A essentially repeats the suction stroke 110, pre-stroke 112 and pumping stroke 114 depicted in FIG. 6 for comparison purposes with FIGS. 11B-11F. Location 116 depicts the bottom dead center ("BDC") location of plunger 74 and location 118 depicts the TDC location of plunger 74. FIG. 11B depicts a known control signal vs. time for comparison purpose.

FIG. 11C depicts the energizing signal of solenoid coil 56 utilized in the noise reduction control method explained above in accordance with the present disclosure. As depicted, the control signal may be turned on or energized beyond a TDC location of cam 86, such as to a BDC location of cam 86. Cam 86 TDC location also corresponds to TDC position of plunger 74.

FIG. 11D depicts an energizing signal of solenoid coil 56 except that such signal is a pulse that is on for less time when compared to the signal of FIG. 11C. That is, an energizing signal may be pulsed on and then off just after TDC position 118 of plunger 74. FIG. 11E depicts another energizing signal of solenoid coil 56 except that such signal may be a decay type of signal in that the energy linearly decreases from a cam location just prior to TDC and finishes decay at a location prior to BDC and after TDC. FIG. 11F depicts another energizing signal of solenoid coil 56 except that such signal is a step type of signal in that the energy decreases in one or more steps from a cam location just prior to TDC and finishes at a location prior to BDC, such as just after TDC.

Figure 12:
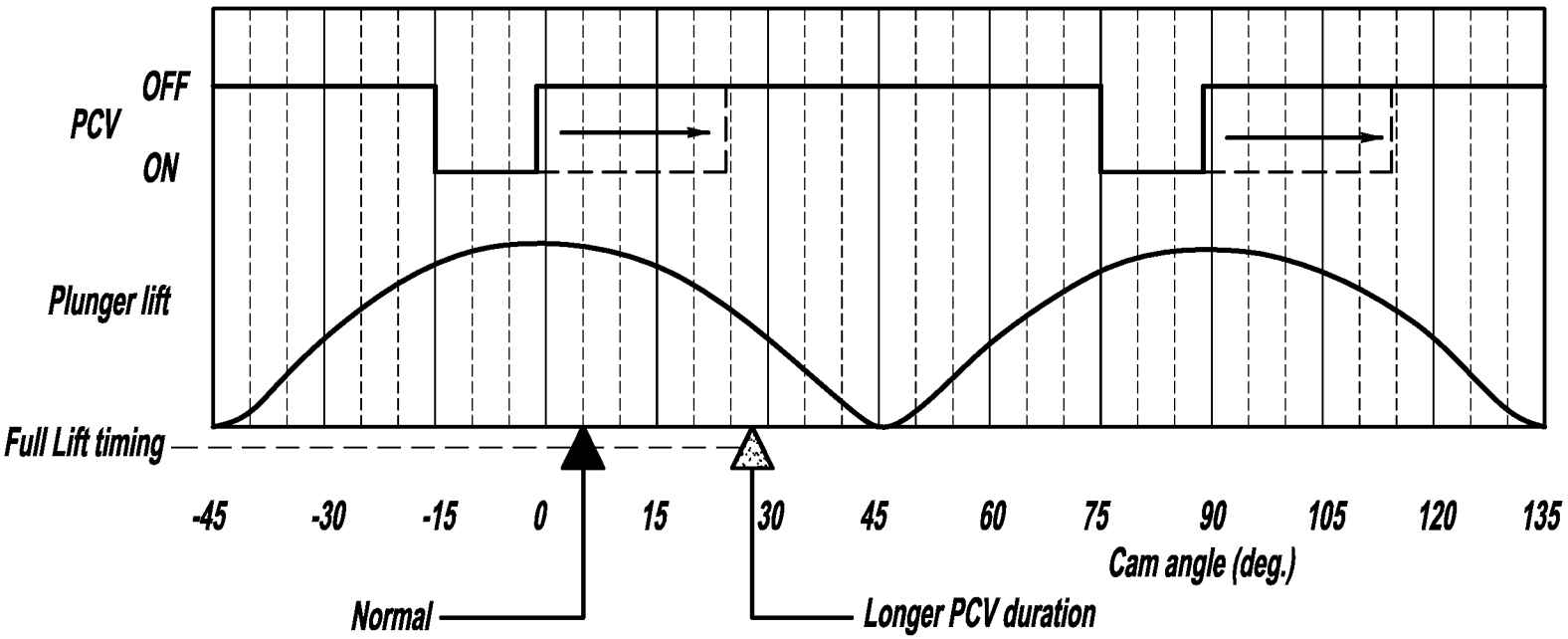
FIG. 12 is a graph of plunger lift position versus cam rotation angle position relative to an on or off states of operation of a pressure control valve.

FIG. 12 is a graph of plunger lift position versus cam rotation angle position (for a cam with 4 lobes with 90 degrees between each lobe) relative to an on or off position of a pressure control valve ("PCV") or solenoid 56. Thus, in FIG. 12 the dashed lines associated with PCV being on indicate a shift and extension of on time relative to cam angle. Thus, solenoid 56 may be turned on at −15 degrees of cam angle before TDC and remain on until between 20 and 25 degrees of cam angle after TDC. Moreover, solenoid 56 may be turned on at 75 degrees of cam angle and remain on until between 110 and 115 degrees of cam angle. Cam angles of −45, 45 and 135 degrees may represent plunger BDC positions and cam angles of 0 and 90 may represent plunger TDC positions.

Thus, a method of controlling a pump 22, which may be a direct injection fuel pump, may entail providing pump 22 with a casing 48 that defines a first chamber 54, a second chamber 62, a third chamber 72 and a fourth chamber 84. The method may also entail providing a fluid inlet 52 in first chamber 54 and a fluid outlet 96 in fourth chamber 84. A first movable valve member 58 may be provided in first chamber 54, a second movable valve member 64 may be provided in second chamber 62, and a third movable valve member 78 may be provided in fourth chamber 84, The method may further entail providing first chamber 54 with a solenoid coil 56 to move first movable vale member 58 to and fro within first chamber 54. During a suction stroke of pump 22, fluid such as fuel 44 may be drawn into first chamber 54 by moving a movable plunger 74 in third chamber 72 away from third chamber 72 thereby creating a vacuum in the third chamber 72 to draw fuel through inlet 52, through first chamber 54, through second chamber 62 and into the third chamber 72. The method may further entail moving third valve member 78 against a valve seat 80 to prevent fuel from exiting through outlet 96.

During a pumping stroke of pump 22 in which pressure within third chamber 72 increases, the method may involve energizing solenoid coil 56 and at the same time or upon energization of solenoid coil 56, attracting first movable valve member 58 toward solenoid coil 56, moving second movable valve member 64 against a valve seat 66, such as with a spring force 68, and moving third movable valve member 78 against a valve seat 80, such as with a spring force, to fluidly isolate third chamber 72 to accept pressurization. The method may also involve maintaining and energized state of solenoid coil 56 before and after a top dead center position of plunger 74. More specifically, plunger 74 may move based on a cam rotation of cam 86, which may have cam lobes. When plunger 74 is deepest into third chamber 72, plunger 74 may be considered to be at a top dead center (TDC) position. When plunger 74 is farthest from third chamber 72, such as when an end of plunger 74 is in contact with cam 86 via a cam follower at a cam portion equally between cam lobes, plunger 74 may be considered to be at a bottom dead center ("BDC") position.

Upon plunger 74 reaching a top dead center position, a new suction stroke may again begin. Thus, after a top dead center position of plunger 74, the method of controlling pump 22 may further involve moving second movable valve member 64 away from valve seat 66 to permit fluid to flow from inlet 52 through first chamber 54 and into second chamber 62, and then into third chamber 72. To lessen noise during operation of pump 22, when pump 22 begins its suction stroke again during its cyclical operation, second movable valve member 64 may, by itself, with no other adjacent valve or needle attached or contacting it, move towards valve stop 104. Immediately after solenoid is de-energized, first movable valve member 58 may contact second movable valve member 64, when suction valve 64 is "floating" between seat 66 and stop 104 and generate noise (Noise A). Then needle 58 or core and suction valve 64 will impact stop 104 and cause another noise (Noise B). However, Noise B will be less than if first movable valve member 58 contacted suction valve (Noise C) and moved together as a single mass the entire distance from seat 66 to stop 104 and impact and cause noise at stop 104 (e.g. noise "D").

In the method described above, spring 60 may at least be partially surrounded by solenoid coil 56. Second chamber 62 may be located immediately next to first chamber 54, separated only by a dividing wall, for example which may define a second aperture. That is, the second aperture 53 may define a passageway between first chamber 54 and second chamber 62. First movable valve member 58, also known as a needle, may at least partially pass through or reside in second aperture 53. That is, first movable valve member 58 may partially pass through or reside within first chamber 54 and partially within second chamber 62. Suction valve spring 68 may be attached to suction valve 64, and suction valve spring 68 may bias against wall 70 to move suction valve 64. Third chamber 72 may be a pressurization chamber 72. Sleeve 90 or cylinder 90 may contain plunger 74 that compresses fuel within pressurization chamber 72. Check valve spring 82 may be attached to check valve 78 to bias the check valve 78 against valve seat 80 to seal fourth chamber 84 from third chamber 72. Valve seat 80 may be part of a wall that divides immediately adjacent third chamber 72 and fourth chamber 84. Cam 86 with cam lobes may rotate and contact an end 89 of plunger 74.

Still yet, a method of controlling a pump may involve providing a first chamber 54 within a chamber casing 48, which defines an inlet 52. The method may also involve providing a first wall 66 that defines a first aperture 53. First chamber 54 may house a solenoid coil 56 and energization and de-energization of solenoid coil 56 controls movement of a first movable valve member 58. The method may also involve providing a second chamber 62 within chamber casing 48 with a second movable valve member 64, the second chamber 62 may be located next to the first chamber 54 and first aperture 53 may define a fluid passageway between first chamber 54 and second chamber 62. The method may further involve providing a third chamber 72 within chamber casing 48 that is open to a sleeve 90, which may be cylindrical, containing a plunger 74. The method may also involve providing a second wall 70 that defines a second aperture 71 as a fluid passageway between second chamber 62 and third chamber 72. The method may also involve providing a fourth chamber 84 with a third movable valve member 78 and a third wall 80 that defines a third aperture 87 between third chamber 72 and fourth chamber 78. Third aperture may define a fluid passageway between third chamber 72 and fourth chamber 78.

The method may involve drawing fluid into third chamber 72 through inlet 52, first chamber 54 and second chamber 62. Energizing solenoid coil 56 may cause movement of first movable valve member 58, which causes second movable valve member 64 to strike and seat against first wall 66. Next, moving plunger 74 may move to a TDC position of plunger 74 and into third chamber 72 to permit pressurization of fluid in third chamber 72. Then, maintaining energization of solenoid coil 56 as plunger 74 moves past the TDC position of plunger 74 will permit first movable valve member 58 to remain against solenoid coil 56 or a stop. Next, energization of solenoid coil 56 may stop thereby causing first movable valve member 58 to move and strike second movable valve member 64. An end of first movable valve member 58 that strikes solenoid coil is opposite from an end of first movable valve member 58 that strikes second moveable valve member 64, and an end of second moveable valve member 64 that strikes wall 70 as a seat, is opposite form an end of second movable valve member 64 that strikes an end of first movable valve member 58. The method may also involve attaching a first movable valve member spring 60 to an end of first movable valve member 58 such that first movable valve member spring 60 lies approximately or in a center of solenoid coil 56 and first movable valve member spring 60 is at least partially surrounded by the solenoid coil 56. The method may also involve providing first movable valve member 58 partially within first chamber 54 and second chamber 62, attaching second movable valve member spring 68 to second movable valve member 64 in a way that second movable valve member spring 68 may bias second movable valve member 64 against seat or wall 70.

The method may also involve providing a cam 86 with a plurality of cam lobes, rotating the cam 86 and contacting an end 89 of plunger 74 with the plurality of cam lobes to move the plunger 74 into and away from third chamber 72. The method may also involve providing a third movable valve member spring 82 attached to third movable valve member 78, and biasing third movable valve member 78 with the third movable valve member spring 82 against third wall 80 to seal fourth chamber 84 from third chamber 72.

Figure 13:
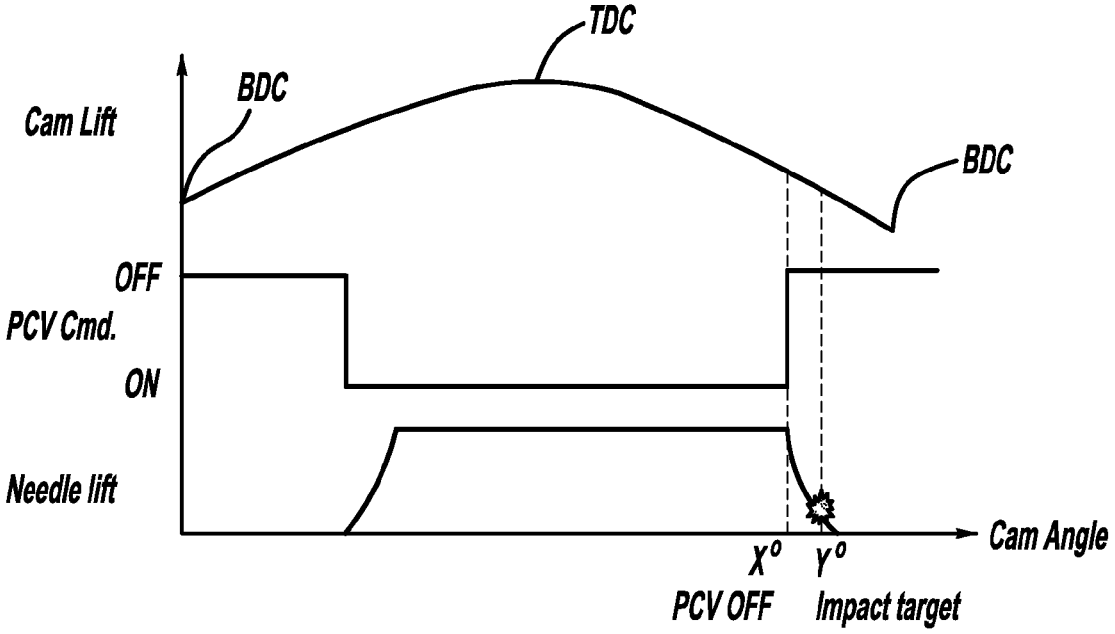
FIG. 13 is a graph depicting cam lift, pressure control valve command or energization, and needle lift versus cam angle.
Figure 14:
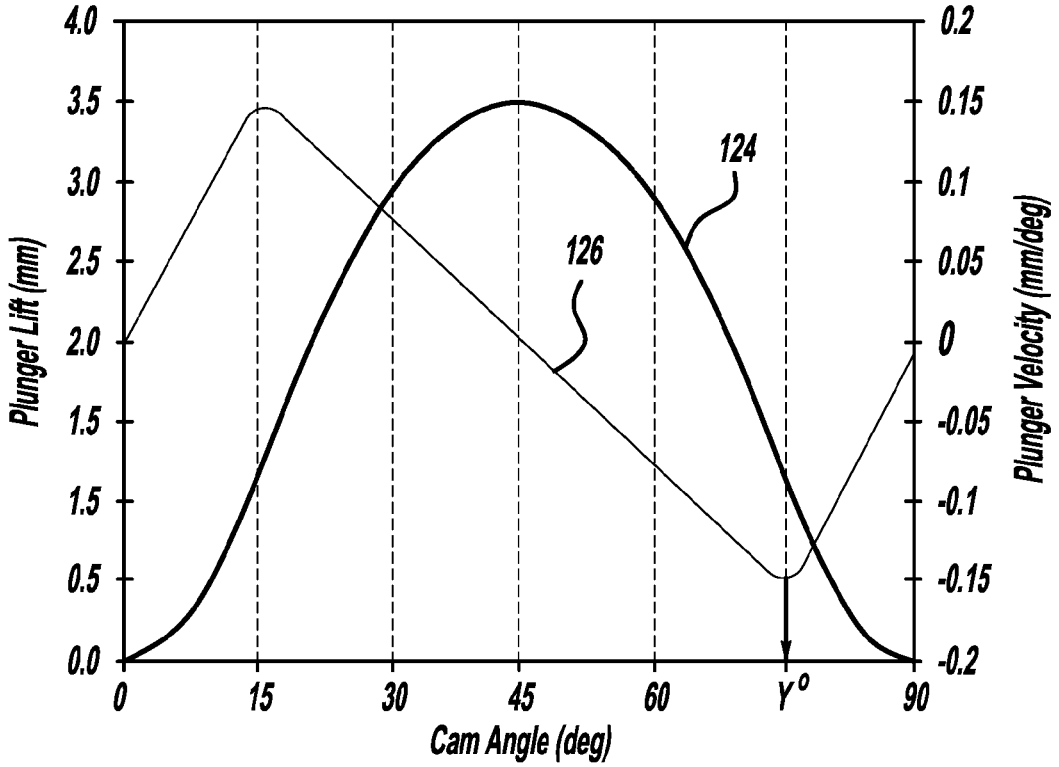
FIG. 14 is a graph depicting plunger lift and plunger velocity versus cam angle.

FIG. 13 is a graph depicting cam lift, pressure control valve command or energization, and needle lift versus cam angle and FIG. 14 is a graph depicting plunger lift and plunger velocity versus cam angle. FIGS. 13 and 14 may be used as part of determining an OFF timing when suction valve 64 is "floating." As previously mentioned, suction valve 64 is also known as second movable valve member 64. With reference to FIG. 4, floating of suction valve 64 may occur when suction valve 64 is between being seated against first wall 66 and against wall 70 or stop 104 (FIG. 5E). Part of an explanation presented above in conjunction with FIGS. 5A-5E explains a method of lessening noise by de-energizing solenoid coil 56 and permitting needle 58 to strike valve member 64 while valve member 64 is "floating" between seat 66 and stop 104, as opposed to at stop 104.

In another method, and with reference to FIG. 6, location 120 along suction stroke profile of curve 73 has a corresponding cam angle associated with it. Location 120 may represent a cam angle at a corresponding PCV OFF timing (solenoid 56 off timing). Similarly, location 122 along suction stroke profile of curve 73 has a corresponding cam angle associated with it. Location 122 may represent a cam angle at a corresponding peak valve velocity of valve 64. FIG. 13 depicts a difference in cam angle of cam 86 of FIG. 4 for example. Although a three lobe cam is depicted in FIG. 4, a four lobe cam may be used. Thus, FIG. 13 depicts "Y degrees" which may correspond to a cam angle to achieve an impact target of needle 58 against suction valve 64 (FIG. 5E). FIG. 13 also depicts "X degrees" which may correspond to a cam angle just prior to "Y degrees." "X degrees" is indicative of a cam angle position at which solenoid 56 should be turned off to achieve a desired timing of an impact target (i.e. timing) of needle 58 against suction valve 64. Thus, at a cam angle corresponding to "X degrees," solenoid 56 is de-energized. Then, at a cam angle corresponding to "Y degrees," needle 58 strikes suction valve 64. At the time that needle 58 strikes suction valve 64, a distance or space still exists between suction valve 64 and stop 104 and plunger 74 may be at its maximum velocity. Moreover, PCV OFF timing should compensate for needle 58 response time, which is equal to the time necessary for a cam contacting plunger 74 via follower 23 to rotate between "X degrees" and "Y degrees" with OFF timing (X) being in advance of impact target (Y).

FIG. 13 further depicts relationships of cam lift, PCV Command (e.g. ON or OFF) and needle lift relative to cam angle of a cam that drives plunger 74, such as cam 86. As depicted, needle lift of needle 58 may decrease upon solenoid 58 being de-energized. Needle lift may be that that distance between an end of needle 58 facing suction valve 64 and suction valve 64, when PCV is energized. Such needle lift distance decreases upon solenoid 58 being de-energized. Still yet, cam lift, or cam position, may be approaching a BDC position, but not yet at a BDC position.

FIG. 14 depicts a plot 124 of plunger lift in (mm) versus cam angle (degrees) and a plot 126 of plunger velocity in (mm/degree) versus cam angle (degrees). An advantage of plots of FIG. 14 is that one can visually see various instantaneous velocities of a plunger and determine when a plunger, such as plunger 74, is at a maximum velocity. In FIG. 14, plunger 74 may be at a maximum velocity at "Y" degrees as indicated along the horizontal axis. Location "Y" on FIG. 14 may correspond to a cam angle of 75 degrees or approximately 75 degrees, a plunger velocity of 0.15 mm/deg, or approximately 0.15 mm/deg, and a plunger lift of between 0.05-0.1 mm. The cam used to attain move plunger 74 may be a three lobe cam, four lobe cam, or other cam. Thus, the off timing of solenoid 56 may occur prior to Y degrees of a cam contacting an end of plunger 74, or in the example noted in FIG. 14, before 75 degrees of cam angle. Thus, de-energizing the solenoid coil may occur a few degrees (e.g. 1-5 degrees) earlier or before the angle at maximum velocity of the second movable valve member (e.g. suction valve) or at a maximum velocity of plunger 74.

Figure 15:
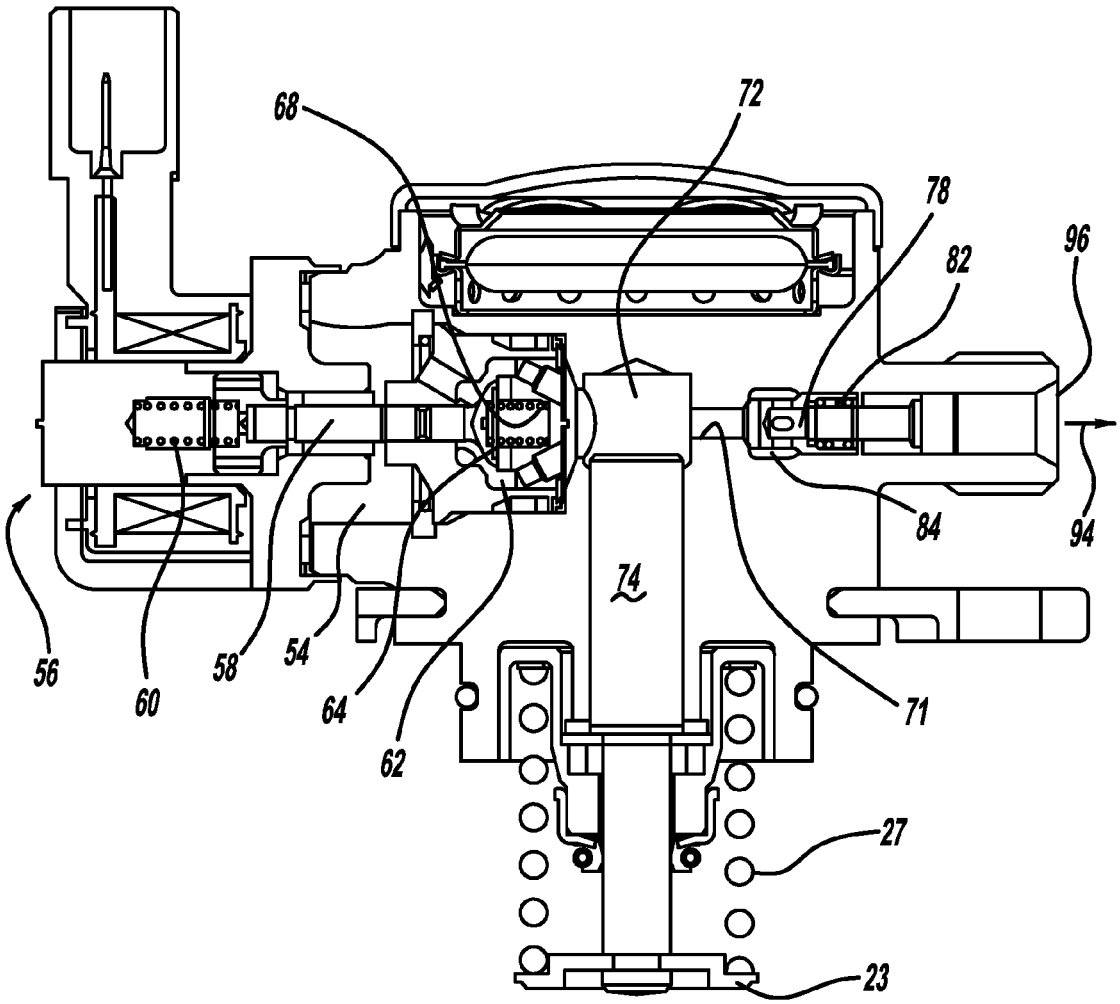
FIG. 15 depicts a cross-sectional view of an embodiment in accordance with the present disclosure.

FIG. 15 depicts a cross-sectional view of an embodiment in accordance with the present disclosure. Corresponding reference numerals indicate corresponding parts throughout the drawings.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

What is claimed is:

1. A method of controlling a pump, comprising:

providing the pump with a casing that defines a first chamber, a second chamber, a third chamber and a fourth chamber;

providing a fluid inlet in the first chamber and a fluid outlet in the fourth chamber;

providing a first movable valve member in the first chamber and a second movable valve member in the second chamber;

providing a third movable valve member in the fourth chamber;

providing a solenoid coil;

during a suction stroke of the pump, moving a plunger in the third chamber away from the third chamber so that a volume of the third chamber increases to move the second valve member toward a stop and to cause the second valve member to collide against the stop;

moving the third valve member against a valve seat to prevent fuel from exiting through the fluid outlet;

during a pumping stroke of the pump, energizing the solenoid coil a first time to attract the first movable valve member toward the solenoid coil; moving the second movable valve member against a second valve seat; maintaining energizing of the solenoid coil before and after a top dead center position of the plunger and then de-energizing the solenoid coil during the suction stroke;

wherein the second movable valve member begins moving before the first movable valve member during the pumping stroke.

2. The method of controlling a pump according to claim 1, further comprising:

preventing fluid flow into the first chamber when the second movable valve member strikes the second valve seat.

3. The method of controlling a pump according to claim 1, wherein the first movable valve member and the second movable valve member are physically separate pieces.

4. The method of controlling a pump according to claim 3, wherein the first chamber and the second chamber are separated.

5. The method of controlling a pump according to claim 3, wherein a wall defines a fluid passage between the first chamber and the second chamber.

6. The method of controlling a pump according to claim 5, wherein energization and de-energization of the solenoid coil controls movement of the first movable valve member.

7. The method of controlling a pump according to claim 6, wherein a second spring resides within the second chamber and biases the second movable valve member.

8. The method of controlling a pump according to claim 7, wherein a first spring resides within the first chamber and biases the first movable valve member toward the second movable valve member.

9. The method of controlling a pump according to claim 1, further comprising:

after the top dead center position, moving the second movable valve member away from the second valve seat to permit fluid to flow from the fluid inlet through the first chamber and into the second chamber.

10. The method of controlling a pump according to claim 9, further comprising:

moving the first movable valve member against the second movable valve member.

11. The method of controlling a pump according to claim 1, further comprising:

moving the second movable valve member in the second chamber further against the stop, which is opposed to the second valve seat; and making the second movable valve member contact the stop, while the second movable valve member is in contact with the first movable valve member.

12. The method of controlling a pump according to claim 1, further comprising:

de-energizing the solenoid coil and causing a needle to move and strike a suction valve.

13. The method of controlling a pump according to claim 12, wherein a needle spring may be attached or provided to an end of the needle such that the needle spring lies proximate a center of the solenoid coil, and the needle spring is at least partially surrounded by the solenoid coil.

14. The method of controlling a pump according to claim 12, wherein de-energizing the solenoid coil occurs prior to maximum velocity of the suction valve.

15. The method of controlling a pump according to claim 12, wherein de-energizing the solenoid coil occurs at a maximum velocity of the plunger.

* * * * *